US005280676A

United States Patent [19]

Fieni

[11] Patent Number: 5,280,676

[45] Date of Patent: Jan. 25, 1994

[54] APPARATUS FOR REMOVING SHINGLES AND NAILS FROM A ROOF

[76] Inventor: Gabriel J. Fieni, 31 Cedar La., Douglassville, Pa. 19518

[21] Appl. No.: 35,625

[22] Filed: Mar. 23, 1993

[51] Int. Cl.[5] ..... A47L 13/02

[52] U.S. Cl. ..... 30/172; 30/344; 81/45

[58] Field of Search ..... 30/169, 171, 172, 299, 30/342, 344; 81/45; D8/89, 16, 19; D32/48

[56] References Cited

U.S. PATENT DOCUMENTS

| | | | |
|---|---|---|---|
| D. 237,353 | 10/1975 | Misch | D8/88 |
| D. 265,791 | 8/1982 | Fieni | D8/88 |
| 1,218,145 | 3/1917 | Whittier | 81/45 |
| 1,512,622 | 10/1924 | Marsh | 30/344 |
| 2,092,279 | 9/1937 | Jeffers | 254/131.5 |
| 2,165,991 | 7/1939 | West | 30/344 |
| 2,769,236 | 11/1956 | Phillips et al. | 30/169 |
| 3,818,593 | 6/1974 | Oliverius | 30/169 |
| 4,086,699 | 5/1978 | Olkkola | 30/172 |
| 4,203,210 | 5/1980 | Hadlick, Jr. | 30/172 |
| 4,477,972 | 10/1984 | Testa, Jr. | 30/172 |
| 4,565,004 | 1/1986 | Heinz | 30/342 |
| 4,809,436 | 3/1989 | Crookston | 30/171 |

*Primary Examiner*—Richard K. Seidel
*Assistant Examiner*—Hwei-Siu Payer
*Attorney, Agent, or Firm*—Joseph Scafetta, Jr.

[57] ABSTRACT

An apparatus for removing shingles and nails from a roof has a hollow handle portion and a replaceable blade portion attached to the handle portion. The blade portion has a front edge, a plurality of first teeth tapered downwardly away from the front edge for removing shingles and nails from the roof on a forward stroke, a rear edge, and a plurality of second teeth turned upwardly away from the rear edge for removing nails from the roof on a backward stroke. The blade portion also has a flat central plate extending between the front edge and the rear edge, a landing section slightly elevated above the flat central plate, and a step for connecting the flat central plate to the slightly elevated landing section. A plurality of slots is cut into an underside of the landing section and extended rearwardly from the front edge for relieving stress on nails pulled by the first teeth from the roof. A mound is positioned near to the rear edge and has a shoulder for receiving a bead of encircling melted metal. The mound also has a protruding stem with either a bore therethrough for receiving a spring pin or at least one side dimple for receiving melted metal so that there are multiple points of attachment for the replaceable blade portion to the hollow handle portion. The plurality of second teeth aligned along the rear edge may be a plurality of claws separated by tapered gaps.

15 Claims, 4 Drawing Sheets

FIG. 1
PRIOR ART
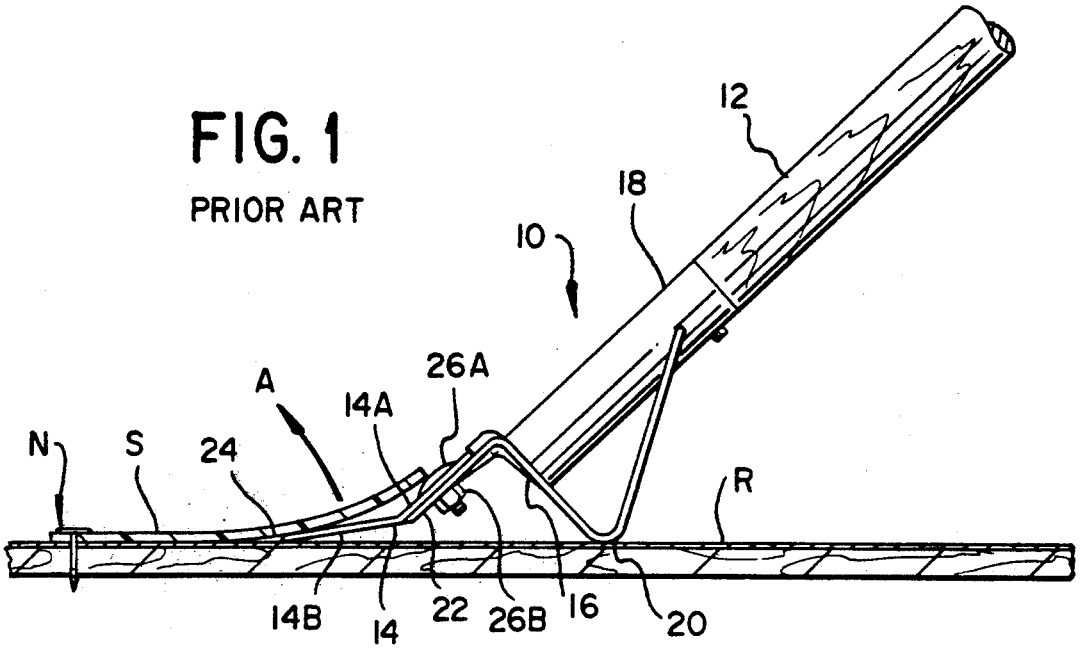
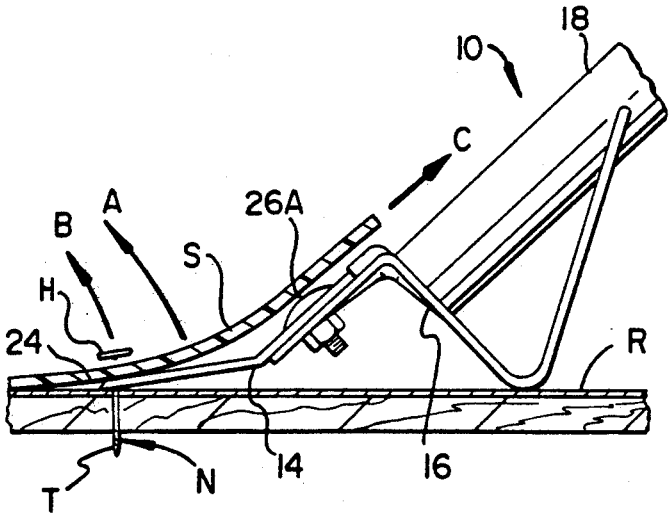
FIG. 2
PRIOR ART
FIG. 3
PRIOR ART
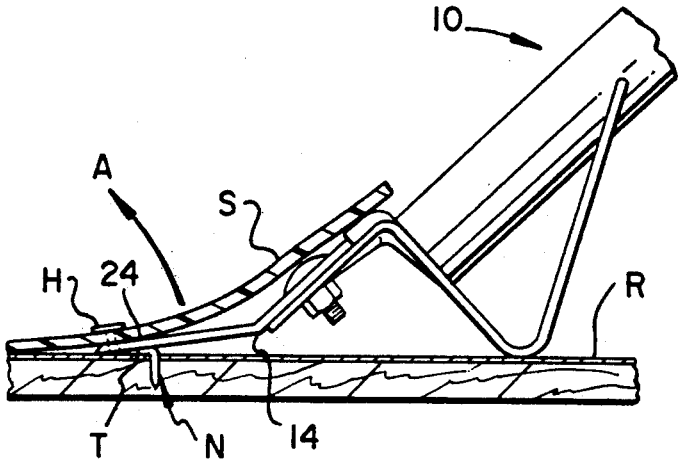

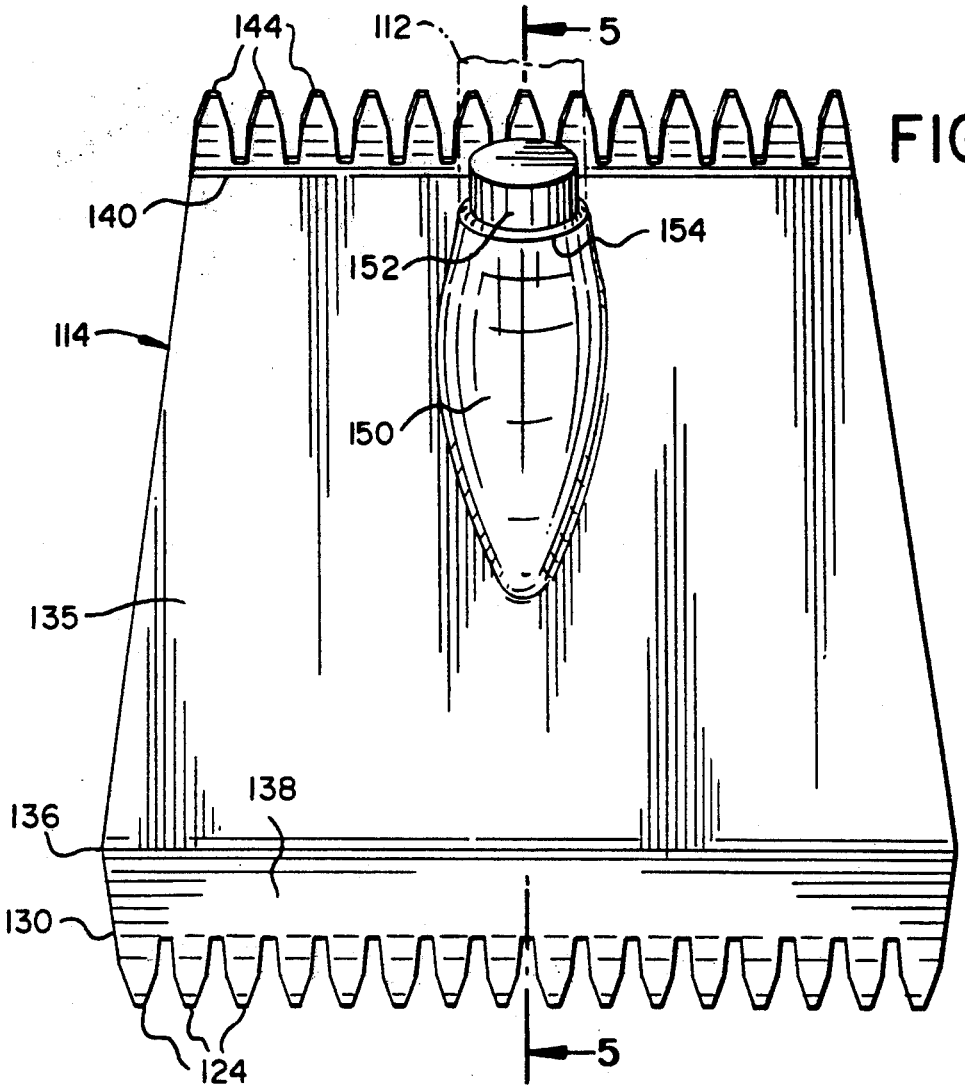
FIG. 4
FIG. 5A
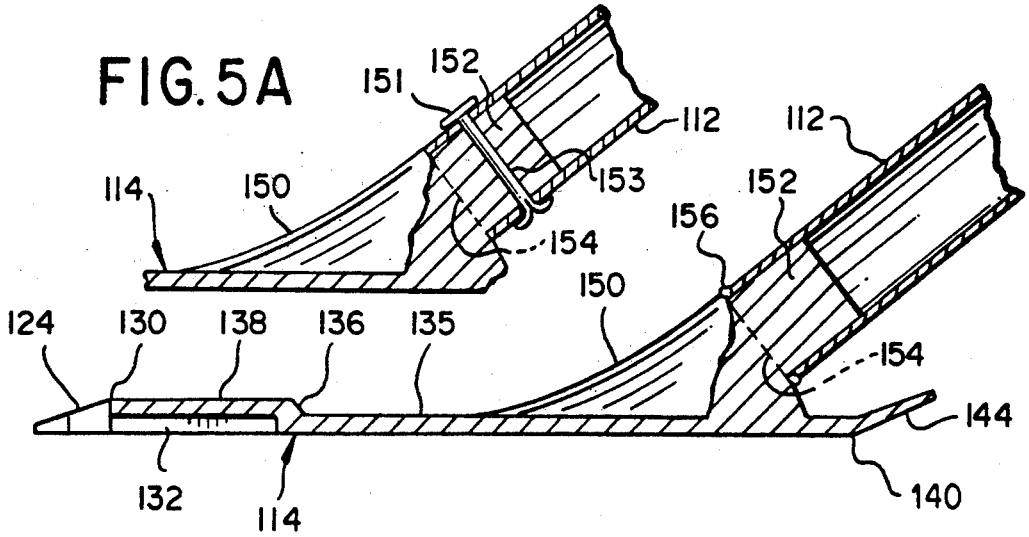
FIG. 5B

APPARATUS FOR REMOVING SHINGLES AND NAILS FROM A ROOF

BACKGROUND OF THE INVENTION

1. Field of the Invention

This invention relates to hand tools and pushing implements generally, but more particularly to scrapers and shingle removers.

2. Description of the Related Art

Hand tools and pushing implements for scraping and removing shingles from roofs are old and well-known in the home improvement field.

Exemplary shingle removing tools are protected by the following: U.S. Utility Pat. No. 4,086,699 which was issued to Olkkola on May 2, 1978; U.S. Design Pat. No. 265,791 which was issued to Fieni on Aug. 17, 1982; U.S. Utility Pat. No. 4,477,972 which was issued to Testa, Jr., on Oct. 23, 1984; and U.S. Utility Pat. No. 4,809,436 which was issued to Crookston on Mar. 7, 1989.

Although all of the above-mentioned tools function adequately to remove shingles on a forward stroke exerted by a worker, none of them perform any useful work on the backward stroke so that half of the energy expended by the worker is lost in unproductive motion.

Furthermore, not all of the effort exerted by the worker on the forward stroke is totally productive because some of the above-mentioned tools either miss nails or shear off the heads of such nails, instead of removing the nails with the shingles from the roof.

In order to illustrate such an unproductive forward stroke, FIGS. 1–3 show the prior art tool disclosed by Crookston in his U.S. utility patent listed above.

In FIG. 1, the prior art tool 10 of Crookston includes a handle 12 and a blade 14 which is secured to the handle 12 by a mounting bracket 16. This mounting bracket 16 has a tubular section 18 which engages a lower end of the handle 12 and a V-shaped fulcrum portion 20. The mounting bracket 16 also has a front plate 22 which is flat and extends substantially parallel to a longitudinal axis of the handle 12. This front plate 22 underlies a rear portion 14A of the blade 14. The blade 14 also has a forward portion 14B on which there is a plurality of teeth 24 spaced laterally along a front edge on the forward portion 14B. The blade 14 is held in place at its rear portion 14A by a fastener, such as a round-headed bolt 26A and a nut 26B, secured to the front plate 22 of the mounting bracket 16.

As the tool 10 is pushed forward along the roof R by the worker gripping the handle 12, the forward portion 14B of the blade 14 is slipped under a shingle S which is moved upwardly in the direction of a first arrow A. Continued movement of the blade 14 forces the shingle S to curve farther upwardly until the teeth 24 reach a nail N.

Referring now to FIG. 2, it can be seen that further forward movement of the tool 10 forces the teeth 24 on the blade 14 to strike a stub T of the nail N at a right angle so that most often a head H of the nail N is sheared completely off and is thrown away from the shingle S in the direction of a second arrow B. Meanwhile, the shingle S continues its upward movement in the direction of the first arrow A while simultaneously sliding over the round-headed bolt 26A in the direction of a third arrow C which is parallel to a longitudinal axis of the tubular section 18 of the mounting bracket 16.

Although it may seem innocuous to the uninitiated that the head H of the nail N is sheared off, this condition is not desirable because the leaving of a lot of short stubs T sticking out of the roof R creates many small channels through which water may enter and cause a number of leaks. A top of each stub T eventually makes a hole in any new shingle S placed thereover. The stubs T work their way through the new shingle S as the worker walks on the roof R. If such stubs T do not immediately force themselves through the new shingle S, they will do so later as the owner and other workers walk on the roof R from time to time to clean gutters, to adjust a TV antenna, to sweep leaves, and to do similar work. When the leak develops, the owner calls back the roofer to find the leak. As one can imagine, finding such a leak caused by a slightly protruding stub T is literally as difficult as finding a proverbial "needle in a haystack."

Furthermore, if the head H is not snapped off from the stub T of the nail N as shown in FIG. 2, the prior art tool 10 of Crookston may pinch the nail N as illustrated in FIG. 3. Although the head H may not always be snapped off the nail N, the stub T thereof is usually deformed by the teeth 24 as the blade 14 is pushed along the roof R in an effort to force the shingle S upwardly in the direction of the arrow A.

These deformed nails N in FIG. 3 pose a problem similar to the one posed by the protruding stubs T in FIG. 2 because, when stepped on by a worker walking on the roof R, either holes or at least indentations are made in the new shingle S, the original roof R, and the shoe soles of the worker.

Additionally, if left in the roof R on the forward stroke of the worker, these deformed nails N are not removed on the backward stroke because there is no nail puller disclosed in any of the known prior art devices for removing the shingles S from the roof R.

Thus, it remains a problem in the prior art to remove the shingles S and all nails N from the roof R without leaving any protruding stubs T and deformed nails N that will eventually break through the new shingles S and cause leaks in the roof R.

SUMMARY OF THE INVENTION

A hand tool for removing shingles and nails from a roof includes a blade and a detachable handle. On a front edge of the blade, there is a first plurality of teeth for removing shingles and nails on a forward stroke of the hand tool along the roof. On an upwardly curved rear edge of the blade, there is a second plurality of teeth for removing nails on a backward stroke of the hand tool along the roof.

It is a primary object of the invention to provide a plurality of slots cut into an underside of a forward portion of the blade immediately behind the first plurality of teeth aligned on the front edge of the blade. This plurality of slots relieves stress on a stub of the nail so that a head thereon is not snapped off.

It is a secondary object of the invention to provide the second plurality of upwardly curved teeth aligned on the rear edge of the blade in such a manner that nails missed on the forward stroke of the hand tool are caught and removed on the backward stroke along the roof.

It is a tertiary object of the invention to provide at least two points for attachment of the handle to the blade so that the handle is not easily broken away from the blade during the course of rough usage by a worker.

These objects, as well as other objects and advantages of the present invention, will be explained hereinafter with reference to the following brief description of the drawings and the subsequent detailed description of the preferred embodiments.

BRIEF DESCRIPTION OF THE DRAWINGS

FIG. 1 shows a side elevational view of a prior art device in its initial stage of use.

FIG. 2 shows a side elevational view of the prior art device during one final stage of use.

FIG. 3 shows a side elevational view of the prior art device during an alternate final stage of use.

FIG. 4 shows a top plan view of a first embodiment of the present invention.

FIG. 5A is a partial cross-sectional view of one variation of the first embodiment taken along line 5—5 in FIG. 4.

FIG. 5B is a cross-sectional view of another variation of the first embodiment taken along line 5—5 in FIG. 4.

DETAILED DESCRIPTION OF THE PREFERRED EMBODIMENTS

Figure 6:
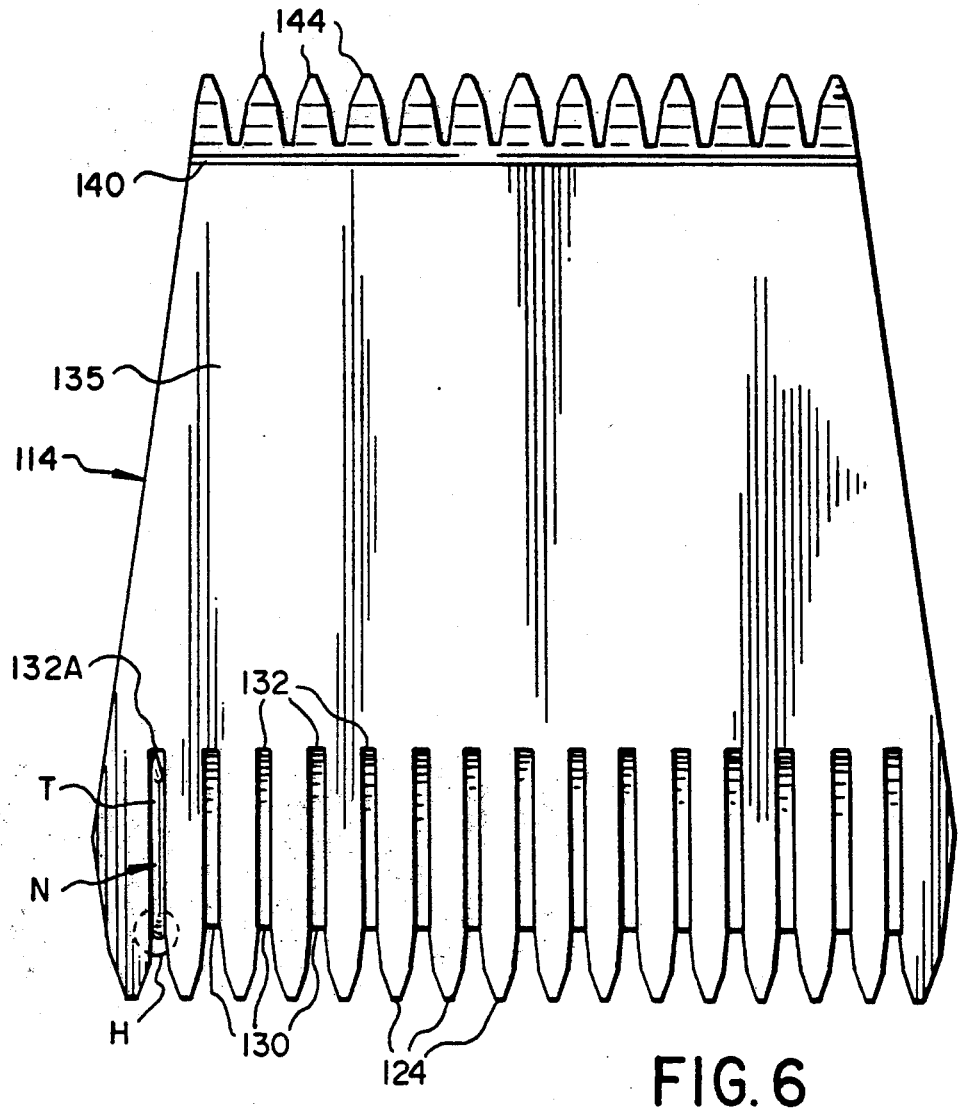
FIG. 6 is a bottom plan view of the first embodiment of the present invention.

In FIG. 4, a first embodiment of the present invention is seen to have a hollow handle portion 112 and a blade portion 114. It is important to note at the outset that, after prolonged use resulting in excessive wear, the blade portion may be replaced by a new one ordered from the manufacturer.

This blade portion 114 has a front edge 130 along which there is aligned a first plurality of teeth 124 which are downwardly tapered away from the front edge 130. The blade portion 114 also has a rear edge 140 along which there is aligned a second plurality of teeth 144 which are upwardly turned away from the rear edge 140. Between the front edge 130 and the rear edge 140, the blade portion 114 has a flat central plate 135. On the flat central plate 135 near to the rear edge 140, there is a mound 150 of metal cast in place with the entire blade portion 114. This mound 150 has a protruding stem 152 over which a bottom end of the hollow handle portion 112 is slipped. The mound 150 also has a shoulder 154 against which the same bottom end of the hollow handle portion 112 abuts.

FIGS. 5A and 5B are cross-sectional views taken along line 5—5 in FIG. 4. In FIG. 5A, there are seen the hollow handle portion 112 and the blade portion 114 which are attached together by either a flexible metal spring pin 151 or a so-called "cotter" pin (not shown) which is passed through a bore 153 previously drilled through walls of the hollow handle portion 112, and the stem 152 on the mound 150. Removal of the spring pin 157 allows a user to replace a worn blade portion 114 quickly and easily.

In FIG. 5B, there are seen the hollow handle portion 112 and the blade portion 114 which are attached together at the shoulder 154 by a bead 156 of welded metal that totally encircles the bottom end of the hollow handle portion 112. The stem 152 on the mound 150 also protrudes into the bottom end of the hollow handle portion 112. It can also be seen that the plurality of second teeth 144 turn upwardly at the rear edge 140 of the blade portion 114. Likewise, it can be seen that the plurality of first teeth 124 taper downwardly away from the front edge 130 of the blade portion 114. The flat central plate 135 of the blade portion 114 has a step 136 which leads to a slightly elevated landing section 138. On an underside of the landing section 138, there is cut a plurality of slots 132 of which only one is illustrated in cross-section in FIG. 5. Each slot 132 extends rearwardly from the front edge 130 of the blade portion 114.

FIG. 6 shows a bottom plan view of the blade portion 114 with its flat central plate 135, its front edge 130 along which the first plurality of teeth 124 is aligned, and its rear edge 140 along which the second plurality of teeth 144 is aligned. The plurality of slots 132 is clearly shown. In a selected end slot 132A, there is seen the nail N with its head H and its stub T caught therein. The slots 132 are sized and cut so that each one is capable of receiving the stub T of the conventional roofing nail N.

Figure 7:
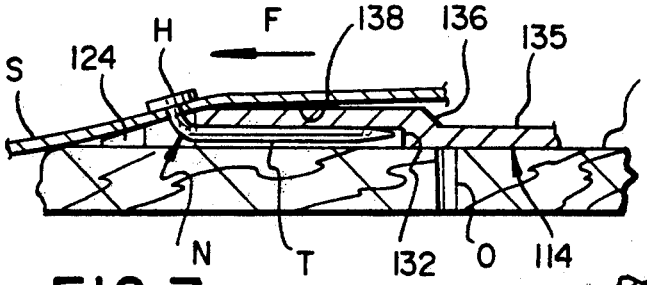
FIG. 7 is a partial cross-sectional view of the first embodiment during a forward stroke of the present invention in use.

The operation of the invention will now be explained with reference to FIGS. 7 and 8. In FIG. 7, a worker pushes the hand tool forward in a direction F along a top surface of the roof R. As the plurality of front teeth 124 advance under the shingle S to be removed, the head H of the nail N is engaged and the stub T of the nail N is pulled out of a hole 0 into which the nail N had been driven many years prior thereto. Because of the existence of the slot 132A, the nail N has its stress relieved as it is extracted from the hole 0 in the roof R. Accordingly, due to the stress relief provided by the plurality of the slots 132, the nails N do not have either their heads H snapped off or their stubs T contorted in the manner shown by the prior art devices in FIGS. 2 and 3. With the nail N remaining intact, the shingle S being removed slides smoothly over the landing section 138, the step 136, and the flat central plate 135 of the blade portion 114.

Figure 8:
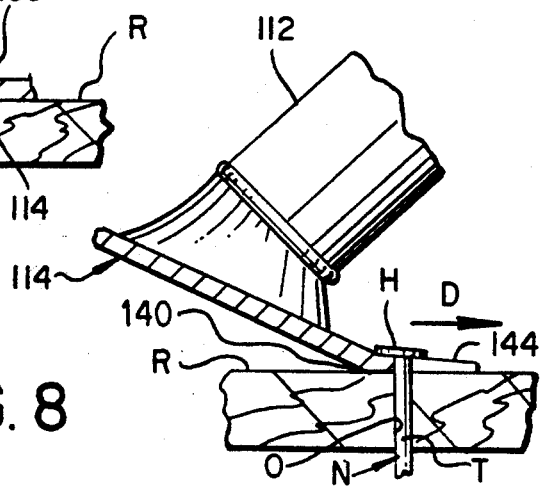
FIG. 8 is a partial cross-sectional view of the first embodiment during a backward stroke of the present invention in use.

FIG. 8 shows what happens in the event that one of the many nails N in the roof R is missed on the forward stroke of the worker. However, note that the shingle S is still ripped away from its position of securement on the top surface of the roof R underneath the head H of the nail N. On the return stroke in a direction D, the worker tilts the handle portion 112 so that the blade portion 114 is raised at an angle to the roof R in order to allow the second plurality of rear teeth 144 to move smoothly across the top surface of the roof R. Because the second teeth 144 on the rear edge 140 are tapered slightly, the head H of any nail N remaining in any hole 0 is engaged from its underside. When the nail N is extracted from the hole 0, the head H is not snapped off and the stub T is not contorted because the nail N is immediately stressed relieved due to the angle at which the blade portion 114 is tilted upwardly away from the top surface of the roof R. Furthermore, since the shingle S has already been ripped away, there is a small space left between the underside of the head H of the nail N and the top surface of the roof R. Due to the existence of this small space, the second teeth 144 along the rear edge 140 are capable of removing nails N with their heads H intact, nails N without heads H but with straight stubs T, and nails N without heads H but with contorted stubs T.

Figure 9:
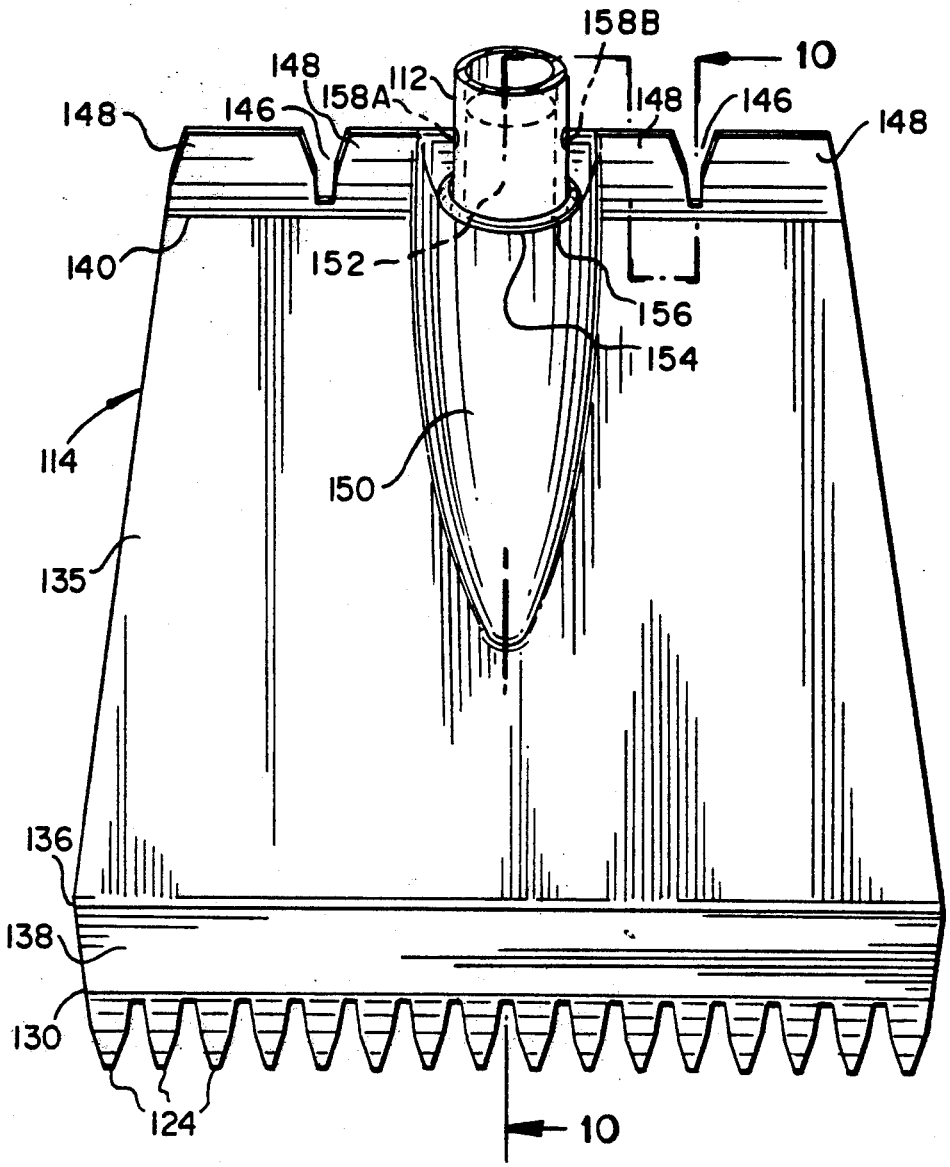
FIG. 9 is a top plan view of a second embodiment of the present invention.

In FIG. 9, there is shown a second embodiment of the present invention. This second embodiment has two features differentiating it from the first embodiment shown in FIGS. 4–8.

As in the top plan view showing the first embodiment in FIG. 4, the second embodiment of FIG. 9 has the hollow handle portion 112, the blade portion 114, the plurality of first teeth 124 on the front edge 130, the landing section 138 connected by the step 136 to the flat central plate 135, and the mound 150 having the shoulder 154 with the stem 152 protruding therefrom. However, instead of securing the handle portion 112 to the mound 150 only by the single bead 156 of welded metal shown in the first embodiment in FIG. 5, this second embodiment has at least one and preferably two dimples 158A and 158B cut into sides of the stem 152. When a hot welding rod (not shown) contacts an outer surface of the handle portion 112 overlaying one of the two side dimples 158A and 158B, the heated metal of the handle portion 112 melts and fills the space of the selected side dimple 158A or 158B. Upon removal of the hot welding rod, the melted metal of the handle portion 112 quickly solidifies to form a tight bond with the stem 152 on the metal mound 150. After both side dimples 158A and 158B are filled with melted metal from the handle portion 112, there results a secure multi-point attachment of the handle portion 112 to the stem 152. In the prior art device seen in FIG. 1, the handle 12 is made of wood and can be easily splintered or broken when the worker pushes too hard.

Figure 10:
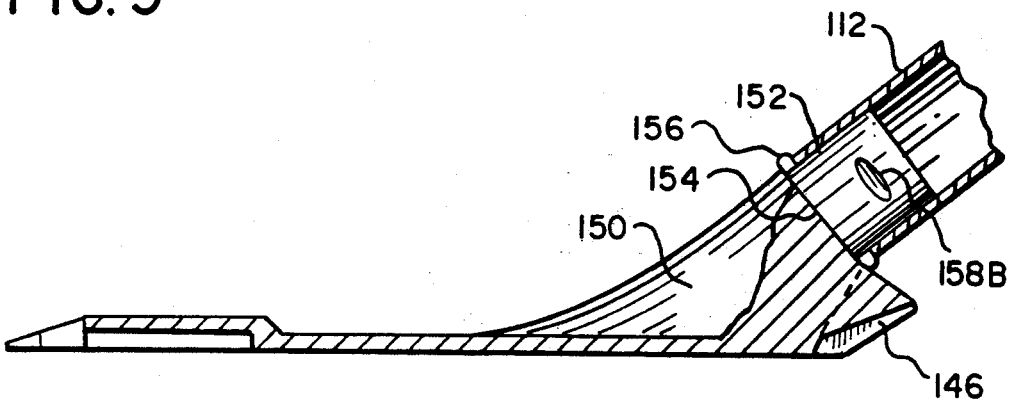
FIG. 10 is a cross-sectional view of the second embodiment taken along line 10—10 in FIG. 9.

In FIG. 10, this multi-point attachment of the handle portion 112 to the stem 152 of the mound 150 is seen as the encircling bead 156 on the shoulder 154 and also as the second side dimple 158B.

Returning to FIG. 9, the second feature which differentiates the second embodiment from the first embodiment of FIGS. 4–8 is a plurality of tapered gaps 146 spaced between upwardly turned claws 148 aligned along the rear edge 140 of the blade portion 114. These tapered gaps 146 between the claws 148 perform for the second embodiment the same function of removing nails N on the back stroke in the direction D, as seen in FIG. 8 for the teeth 144 in the first embodiment. Although in FIG. 9 there are only two tapered gaps 146 illustrated, a third tapered gap 146 may be hidden behind the handle portion 112 in a further embodiment not shown. The rightmost tapered gap 146 of FIG. 9 is clearly seen in the partial cross-sectional view of FIG. 10. Furthermore, as best shown in FIG. 9, the claws 148 separated by the tapered gaps 146 in this second embodiment can be considered analogous to laterally elongated teeth 144 in the first embodiment of FIGS. 4–8. In other words, one claw 148 in the second embodiment is functionally equivalent to at least one pair of the teeth 144 in the first embodiment.

The foregoing two preferred embodiments are considered illustrative only. Numerous other modifications will readily occur to those persons skilled in the pertinent technology after reading the foregoing disclosure. Consequently, the disclosed invention is not limited by the exact structure and use shown and described, but rather is defined by the following claims.

I claim as my invention the following:

1. An apparatus for removing shingles and nails from a roof, comprising:

(a) a handle portion; and (b) a blade portion attached to the handle portion;

wherein said blade portion includes a front edge; a plurality of first teeth means, aligned along the front edge, for removing shingles and nails from the roof; a rear edge; and a plurality of second teeth means, aligned along the rear edge, for removing nails from the roof;

wherein said blade portion further includes a flat central plate, a landing section slightly elevated above the flat central plate, and a step means for connecting the flat central plate to the slightly elevated landing section.

2. The apparatus according to claim 3, wherein:

said plurality of first teeth means is tapered downwardly away from the front edge of the blade portion.

3. The apparatus according to claim 1, wherein:

said blade portion further includes a plurality of slot means, cut into an underside of the landing section and extending rearwardly from the front edge of the blade portion, for relieving stress on nails pulled by the first teeth means from the roof.

4. The apparatus according to claim 3, wherein:

said blade portion further includes a mound positioned near the rear edge of the blade portion.

5. The apparatus according to claim 4, wherein:

said mound has a stem means for protruding into one hollow end of the handle portion.

6. The apparatus according to claim 5, wherein:

said stem means has a bore means for receiving a spring pin.

7. The apparatus according to claim 5, wherein:

said mound further has a shoulder means for abutting against the one hollow end of the handle portion and also for receiving a bead of encircling melted metal.

8. The apparatus according to claim 7, wherein:

said stem means has at least one side dimple means for receiving melted metal whereby the handle portion is securely attached to the blade portion by melted multiple points on the stem means.

9. The apparatus according to claim 3, wherein:

said plurality of second teeth means is turned upwardly away from the rear edge of the blade portion.

10. The apparatus according to claim 9, wherein:

said plurality of second teeth means is a plurality of claws separated by tapered gaps.

11. An apparatus for removing shingles and nails from a roof, having a replaceable blade portion comprising:

(a) a front edge;

(b) a plurality of first teeth means, tapered downwardly away from the front edge and aligned along the front edge, for removing shingles and nails from the roof;

(c) a rear edge;

(d) a plurality of second teeth means, turned upwardly away from the rear edge and aligned along the rear edge, for removing nails from the roof;

(e) a flat central plate extending between the front edge and the rear edge;

(f) a landing section slightly elevated above the flat central plate; and (g) a step means for connecting a flat central plate to the slightly elevated landing section.

12. The apparatus according to claim 11, wherein the replaceable blade portion further comprises:

(h) a plurality of slot means, cut into an underside of the landing section and extended rearwardly from the front edge, for relieving stress on nails pulled by the first teeth means from the roof.

13. The apparatus according to claim 11, wherein the replaceable blade portion further comprises:

(h) a mound positioned near the rear edge.

14. The apparatus according to claim 13, wherein: said mound has a stem with a bore means for receiving a spring pin.

15. The apparatus according to claim 11, wherein: said plurality of second teeth means is a plurality of claws separated by tapered gaps.

* * * * *

UNITED STATES PATENT AND TRADEMARK OFFICE

CERTIFICATE OF CORRECTION

PATENT NO. : 5,280,676

DATED : January 25, 1994

INVENTOR(S) : Gabriel J. Fieni

It is certified that error appears in the above—identified patent and that said Letters Patent is hereby corrected as shown below:

Col. 3, line 64, after "153", insert --,--.

Col. 4, line 16, change "5" to --5B--.

Col. 6, line 14, in claim 2, change "3" to --1--;

line 21, in claim 3, change "extending" to --extended--;

line 24, in claim 4, change "3" to --1--;

line 44, in claim 9, change "3" to --1--; and line 67, in claim 11, change "a" (second occurrence) to --the--.

Signed and Sealed this

Nineteenth Day of July, 1994

Bruce Lehman

*Attest:*

BRUCE LEHMAN

*Attesting Officer*

*Commissioner of Patents and Trademarks*